United States Patent [19]

Ogawa

[11] 4,432,433

[45] Feb. 21, 1984

[54] NOISE REDUCING COVER FOR INTERNAL COMBUSTION ENGINE

[75] Inventor: Naoki Ogawa, Yokohama, Japan

[73] Assignee: Nissan Motor Company, Ltd., Yokohama, Japan

[21] Appl. No.: 296,510

[22] Filed: Aug. 26, 1981

[30] Foreign Application Priority Data

Sep. 3, 1980 [JP] Japan ..... 55-125239[U]

[51] Int. Cl.[3] ..... F01N 1/24

[52] U.S. Cl. ..... 181/204; 181/294

[58] Field of Search ..... 181/200, 204, 207–209, 181/291, 294, 256

[56] References Cited

U.S. PATENT DOCUMENTS

| | | | |
|---|---|---|---|
| 3,895,143 | 7/1975 | Tarlow | 181/294 X |
| 4,035,215 | 7/1977 | Goldstone . | |
| 4,040,213 | 8/1977 | Capaul | 181/291 X |
| 4,048,366 | 9/1977 | Kingsbury | 181/204 X |

FOREIGN PATENT DOCUMENTS

| | | |
|---|---|---|
| 2097774 | 3/1972 | France . |
| 2166715 | 8/1973 | France . |
| 2234627 | 1/1975 | France . |
| 499667 | 1/1939 | United Kingdom . |

*Primary Examiner*—Benjamin R. Fuller

*Attorney, Agent, or Firm*—Schwartz, Jeffery, Schwaab, Mack, Blumenthal & Koch

[57] ABSTRACT

A noise reducing cover for an internal combustion engine, comprising a layer formed of a material which is high in damping capacity, and metal fibers contained in the high damping capacity material, thereby effectively preventing engine noise emission, maintaining good heat conductivity therethrough.

13 Claims, 8 Drawing Figures

NOISE REDUCING COVER FOR INTERNAL COMBUSTION ENGINE

BACKGROUND OF THE INVENTION

1. Field of the Invention

This invention relates to various covers for an internal combustion engine for use as an engine front cover, an oil pan and the like, and more particularly to such covers which are arranged to decrease the emission of engine noise.

2. Description of the Prior Art

Covers for moving parts of internal combustion engines, as in cylinder head covers (rocker covers), oil pans, valve lifter covers, and the like traditionally have been formed from sheet metal. Solid sheet metal is hardly a vibration or sound absorbing material; in fact, solid metal is one of the best sound and vibration conductors as well known. When a cylinder head cover or the like is rigidly mounted to an internal combustion engine, which of course, it must be in order to perform its intended function, the cover itself becomes an excellent conductor of noise and vibration produced by the internal combustion engine. In fact, due to the shape of certain types of such covers having large, essentially flat sections, these covers becomes excellent amplifiers of engine noise. Additionally, engine vibration is transmitted to the particular cover, thus creating another source of noise, i.e. the vibration of the cover itself.

SUMMARY OF THE INVENTION

In accordance with the present invention, a noise reducing cover for an internal combustion engine, consists of a layer formed of a material which is high in damping capacity. The high damping capacity material contains therein metal fibers. With such a noise reducing cover, various engine noises can be effectively damped, thereby decreasing noise emission through the noise reducing cover. Additionally, by virtue of the heat-conductive metal fibers contained in the high damping capacity material, heat inside the noise reducing cover can be effectively conducted through the noise reducing cover to be emitted to ambient air, thereby preventing the engine from overheat thereof.

BRIEF DESCRIPTION OF THE DRAWINGS

The features and advantages of the noise reducing cover according to the present invention will be more clearly appreciated from the following description taken in conjunction with the accompanying drawings in which like reference numerals designate the corresponding parts and elements in which.

DETAILED DESCRIPTION OF THE INVENTION

Figure 1:
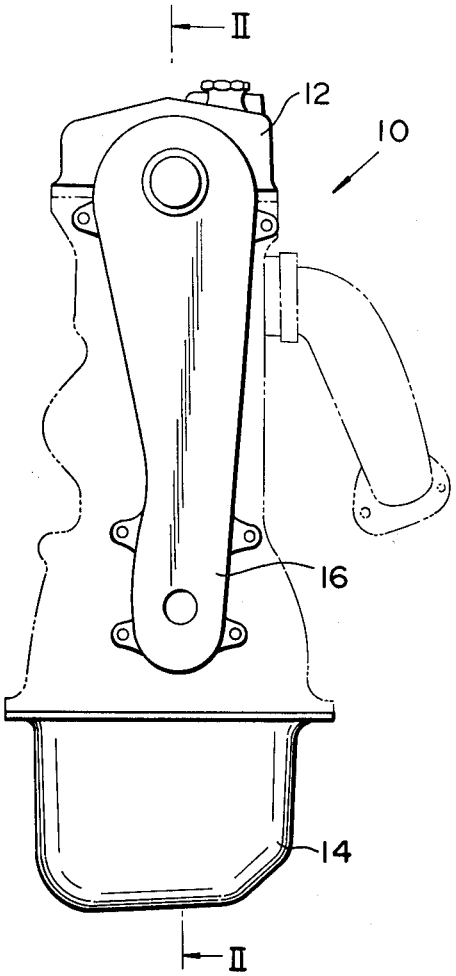
FIG. 1 is a front elevation showing various covers according to the present invention, installed onto an internal combustion engine.
Figure 2:
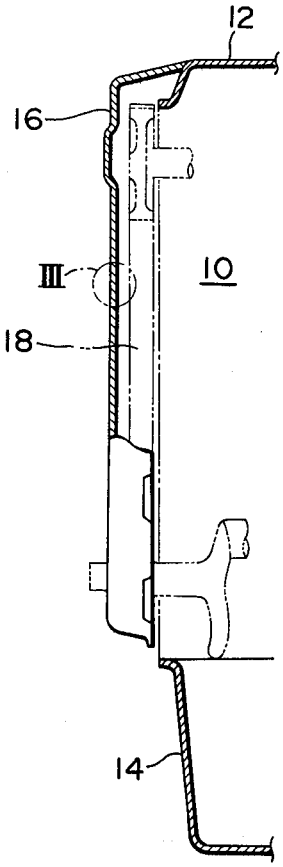
FIG. 2 is a cross-sectional view taken in the direction of arrows substantially along the line II—II of FIG. 1.
Figure 3:
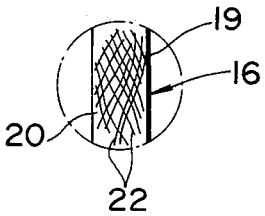
FIG. 3 is an enlarged sectional view of a part enclosed with a dot-dash circle III of FIG. 2.

Referring now to FIGS. 1 to 5 particularly to FIG. 1, there are shown a variety of noise reducing covers according to the present invention, used in combination with an internal combustion engine 10 which is, for example, mounted on an automotive vehicle. The covers, in this instance, include a rocker cover 12, an oil pan 14, and an engine timing chain cover 16 for covering a timing chain 18 connecting a camshaft (no numeral) and a crankshaft (no numeral) as best seen in FIG. 2. This timing chain cover 16 is formed of a single layer 19 made of a material 20 (such as organic or inorganic fibrous material, rubber, plastic of the like) which is higher in damping capacity and contains therein metal fibers 22 as shown in FIG. 3. The metal fibers may be made of various metal materials.

Figure 4:
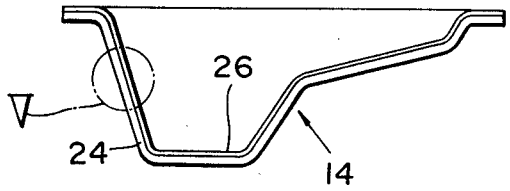
FIG. 4 is a cross-sectional view of an oil pan of FIG. 1.
Figure 5:
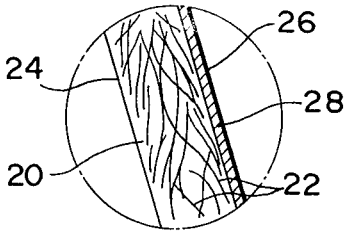
FIG. 5 is an enlarged cross-sectional view of a part enclosed with a dot-dash circle V of FIG. 4.

As shown in FIGS. 4 and 5, the oil pan 14 is constituted by outer and inner layers 24, 26 which are securely integrally attached with each other. The outer layer 24 is formed of the material 20 which is high in damping capacity and contains the metal fibers 22. The inner layer 26 comes into contact with engine oil and is, therefore, formed of a material 28 having an oilproof characteristic or ability to prevent engine oil from passing therethrough. The material 28 forming the inner layer 26 is, for example, a resin film made of polyester resin allylic resin, polyimide resin, polyethersulphone resin, or the like; a metal film such as aluminum foil; or a rubber film made of NBR (acrylonitrile-butadiene rubber), acrylic elastomer or the like. It will be understood that the rocker cover 12 is also formed of first and second layers 24, 26 which are made of the same materials as in the oil pan 14, though not shown.

With such covers used for the engine, since the metal material contained in the high damping capacity material is in the form of fibers, the damping characteristics of the high damping capacity material is not deleteriously affected. Additionally, by virtue of the heat-conductive metal material (metal fibers) contained in the high damping capacity material, the heat inside the noise reducing covers 12, 14, 16 can be effectively transmitted to the outside of the covers. It will be understood that the heat on the outside surface of the covers is further cooled by wind caused by vehicle cruising or by cooling air caused by an engine cooling fan (not shown) of the engine. As a result, heat release from the noise reducing cover is sufficient and therefore engine oil and coolant temperatures can be effectively prevented from excessively rising, thereby avoiding engine overheat. Additionally, by virtue of the fact that the metal material contained in the high damping capacity material is in the form of fibers, the damping effect of the high damping capacity material is not reduced. Furthermore, the metal fibers in the high damping capacity material contributes to an increase in strength and rigidity of the noise reducing covers of the enigne, greatly improving the noise reduction effect to combustion noise, tappet noise and the like generated inside the noise reducing cover.

Figure 6:
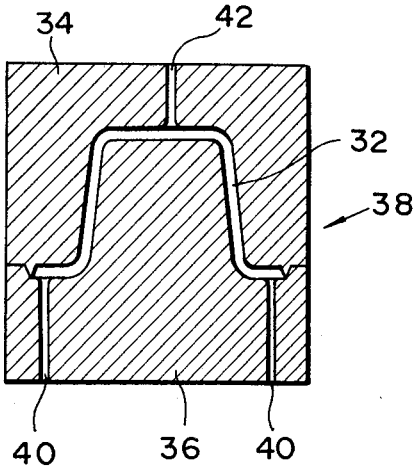
FIG. 6 is a cross-sectional view showing a die section of a press-machine.
Figure 7:
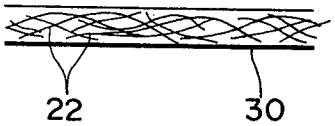
FIG. 7 is a cross-sectional view of a metal fiber layer formed in the press-machine die section.
Figure 8:
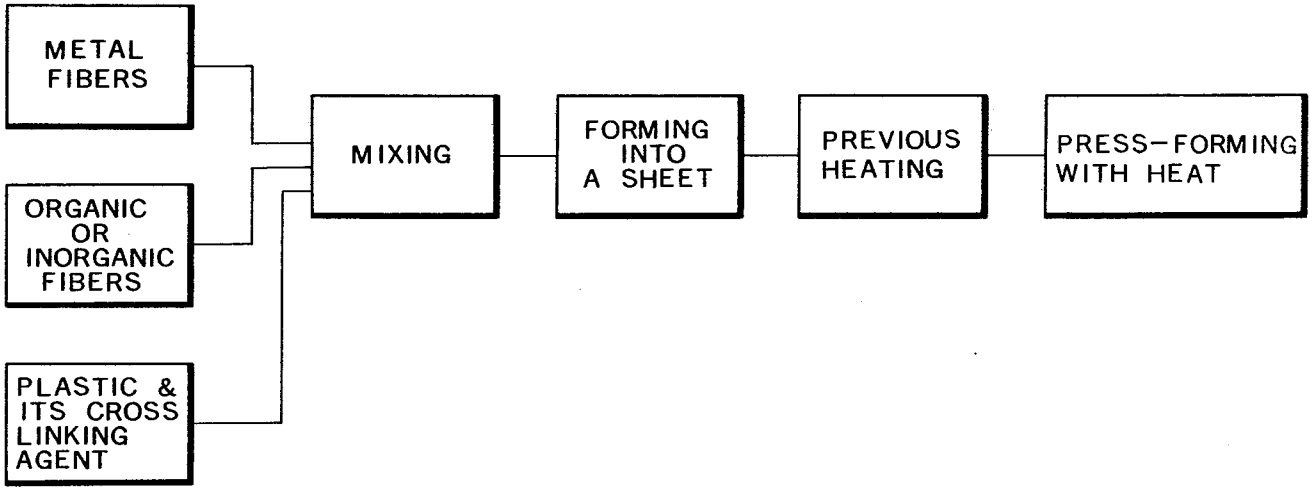
FIG. 8 is a block diagram illustrating an example of process for preparing the noise reducing cover according to the present invention.

FIGS. 6 to 8 illustrate an example of producing the noise reducing cover in accordance with the present invention. First, a metal fiber layer 30 is formed by compressing metal fibers within a cavity or aperture 32 formed between upper and lower dies 34, 36 of a press-machine 38. Thereafter, a fluid material such as plastic or rubber is supplied into the cavity 32 through elongate openings 40 formed in the lower die 36. As a result, a high damping capacity layer containing therein metal fibers is formed within the cavity between the upper and lower dies 34, 36. As shown, the upper die 34 is formed with an air vent opening 42 for venting air within the cavity 32 when the fluid material such as plastic or rubber is supplied to the cavity 32. It will be understood that the fluid material to be supplied into the cavity 32 may be foamed.

FIG. 8 illustrates an example of a process to prepare the noise reducing cover by mixing metal fibers in a high damping capacity material (plastic) which is provided with organic or inorganic fibers as a filler. In FIG. 8, the step of forming the mixture into a sheet is performed by using rollers. At the step of a previous heating, the cross linking reaction of the plastic is partially carried out by virtue of a cross linking agent mixed therein, so that the treatment of plastic material in the sheet form is facilitated. At the step of a heated press-forming, the cross linking reaction of the plastic material is completed so that the fibers are connected with each other. As a result, the sheet-formed plastic material is formed into a desired shape, obtaining a sufficient strength and rigidity.

As appreciated from the above, according to the present invention, the various noise reducing covers used in the engine are formed by mixing metal fibers in the high damping materials such as rubber, plastic, organic or inorganic fiber material or the like. Therefore, the thus formed noise reducing covers are high in strength or rigidity and high in heat-release efficiency, maintaining a sufficient noise reduction effect.

What is claimed is:

1. A noise reducing cover for an internal combustion engine, comprising:

a first layer formed into a self supporting three dimensional shape and of a first material which is high in vibration damping capacity, said first layer having an inner surface adapted to receive heat from the engine, and an outer surface directly contacting with ambient air; and means for effectively transmitting heat from said inner surface of said first layer to said outer surfae of said first layer, said heat transmitting means including metal fibers contained in said first layer of high vibration damping capacity material.

2. A noise reducing cover as claimed in claim 1, wherein said first material is at least one selected from the group consisting of organic fibers, inorganic fibers, rubber, and plastic.

3. A noise reducing cover as claimed in claim 1, further comprising a second layer formed of a second material having an oilproof ability and securely attached to said first layer.

4. A noise reducing cover as claimed in claim 3, wherein said second material is one selected from the group consisting of a plastic film, a metal film, and a rubber film.

5. A noise reducing cover as claimed in claim 4, wherein said plastic film is made of a material selected from the group consisting of polyester resin, allylic resin, polyimide resin, polyethersulphone resin.

6. A noise reducing cover as claimed in claim 4, wherein said metal film is aluminum film.

7. A noise reducing cover as claimed in claim 4, wherein said rubber film is made of a material selected from the group consisting of NBR and acrylic elastomer.

8. A noise reducing cover as claimed in claim 1, wherein siad first material is formed into a predetermined shape by press-forming upon heating.

9. A noise reducing cover as claimed in claim 8, wherein said first material is a thermosetting plastic material.

10. A noise reducing cover for an internal combustion engine, comprising:

a first layer formed into a self supporting three dimensional shape and of a first material which is high in vibration damping capacity, said first material being selected from the group consisting of rubber and plastics, said first layer having an inner surface adapted to receive heat from the engine, and an outer surface directly contacting with ambient air; and means for effectively transmitting heat from said first layer inner surface to said first layer outer surface, said heat transmitting means including metal fibers contained in said first layer of high vibration damping capacity material.

11. A noise reducing cover mounted on an internal combustion engine, said cover comprising:

a shape sustaining layer of high vibration damping material; and metal fibers contained in said layer for transmitting heat through said layer;

wherein said layer has an outer surface which defines the outer shape of said cover and directly contacts ambient air surrounding said cover for improving heat dissipation characteristics of said cover, and said layer has an inner surface in heat transfer relationship with said engine.

12. The cover of claim 11, wherein said layer is the only layer of said cover and said inner surface forms the innermost surface of said cover and is directly exposed to the covered area of said engine.

13. The cover of claim 11, wherein an oil impervious layer is bonded to said inner surface and said oil impervious layer has an inner surface directly exposed to the covered area of said engine.

* * * * *